US007619396B2

(12) United States Patent
Chuang et al.

(10) Patent No.: US 7,619,396 B2
(45) Date of Patent: Nov. 17, 2009

(54) THERMAL DISSIPATION IMPROVED POWER SUPPLY ARRANGEMENT AND CONTROL METHOD THEREOF

(75) Inventors: Chao-Hsuan Chuang, Jhubei (TW); Cheng-Hsuan Fan, Hsinchu (TW); Hung-Che Chou, Jiadung Township, Pingtung County (TW); Ching-Hsiang Yang, Tauyuan (TW); Chih-Ping Tan, Chiunglin Township, Hsinchu County (TW)

(73) Assignee: Richtek Technology Corp., Hsinchu (TW)

( * ) Notice: Subject to any disclaimer, the term of this patent is extended or adjusted under 35 U.S.C. 154(b) by 0 days.

(21) Appl. No.: 11/526,624

(22) Filed: Sep. 26, 2006

(65) Prior Publication Data

US 2007/0075690 A1 Apr. 5, 2007

(30) Foreign Application Priority Data

Sep. 30, 2005 (TW) ..... 94134162 A

(51) Int. Cl.
*G05F 1/59* (2006.01)
*G05F 1/613* (2006.01)

(52) U.S. Cl. ..... 323/269; 307/81

(58) Field of Classification Search ..... 323/269, 323/270, 273; 307/80–82, 85, 86; 363/65
See application file for complete search history.

(56) References Cited

U.S. PATENT DOCUMENTS 5,814,903 A * 9/1998 Wu ..... 307/125
6,144,115 A * 11/2000 Massie et al. ..... 307/80
6,654,264 B2 * 11/2003 Rose ..... 363/65
7,166,991 B2 * 1/2007 Eberlein ..... 323/280

* cited by examiner

*Primary Examiner*—Gary L Laxton
(74) *Attorney, Agent, or Firm*—Rosenberg, Klein & Lee

(57) ABSTRACT

Time-sharing technique is used for power conversion to improve the thermal dissipation thereof. In a power supply arrangement to provide a supply voltage to a load, a plurality of linear regulators are so switched that each time only one of them is enabled to convert an input voltage to the supply voltage, thereby each of them suffering less thermal dissipation.

5 Claims, 5 Drawing Sheets

THERMAL DISSIPATION IMPROVED POWER SUPPLY ARRANGEMENT AND CONTROL METHOD THEREOF

FIELD OF THE INVENTION

The present invention is related generally to power conversion arrangement and method and, more particularly, to thermal dissipation improvement in an arrangement for power conversion.

BACKGROUND OF THE INVENTION

FIG. 1 shows a low dropout (LDO) regulator 10, which is a linear regulator and is capable of converting an input voltage VIN to be a supply voltage VOUT if it is enabled by an enable signal ENABLE. FIG. 2 shows a circuit diagram of a typical LDO regulator 10, which comprises a transistor 14 connected between an input voltage VIN and the regulator output VOUT, two resistors R1 and R2 connected between the regulator output VOUT and ground GND to serve as a voltage divider to divide the supply voltage VOUT to generate a feedback voltage VFB, and an amplifier 12 to control the transistor 14 in response to the difference between the feedback voltage VFB and a reference voltage Vref, so as to maintain the supply voltage VOUT at a desired value. However, when the LDO regulator 10 operates in high current condition, due to its poor thermal dissipation, the LDO regulator 10 is usually operated with degraded performance, and even damaged.

To improve the over thermal condition, FIG. 3 shows an ideal solution, which uses two common-output LDO regulators 20 and 22 to equally share the loading current I. Since each of the LDO regulators 20 and 22 operates with only half of the loading current I, the power dissipation is shared to them, and the thermal dissipation in each of them is reduced. In practice, however, even if the LDO regulators 20 and 22 are produced by the same manufacturing process or produced in the same batch, they may generate different output voltages. For example, 3V is the supply voltage VOUT the designer desires each of the LDO regulators 20 and 22 to generate, while actually, the LDO regulator 20 may generate a deviated one, for example 3V+1% or 3.03V, and the LDO regulator 22 may generate another one, for example 3V−1% or 2.97V. In this case, because the regulated voltage provided by the LDO regulator 22 is lower than that by the LDO regulator 20, the LDO regulator 22 will not work when the power supply arrangement of FIG. 3 operates, and as a result, the loading current I will be supplied by the LDO regulator 20 alone. Therefore, this approach will not really improve the thermal dissipation and the performance.

Therefore, it is desired a power supply arrangement and a control method thereof which really share the thermal dissipation by multiple linear regulators.

SUMMARY OF THE INVENTION

An object of the present invention is directed to the thermal dissipation improvement of a power supply arrangement having multiple linear regulators.

According to the present invention, time-sharing technique is used for power conversion to improve the thermal dissipation thereof. Preferably, a power supply arrangement comprises a plurality of common-output linear regulators, and a time-sharing control scheme is employed in serial or parallel manner to enable the linear regulators in turn to convert an input voltage to a supply voltage. Preferably, a clock is used for the time-sharing control to enable the linear regulators. Since each time only one of the linear regulators is enabled for generate the regulated output voltage, the whole thermal dissipation for the power conversion is shared to the linear regulators, and each of the linear regulators suffers only a less thermal dissipation.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 2:
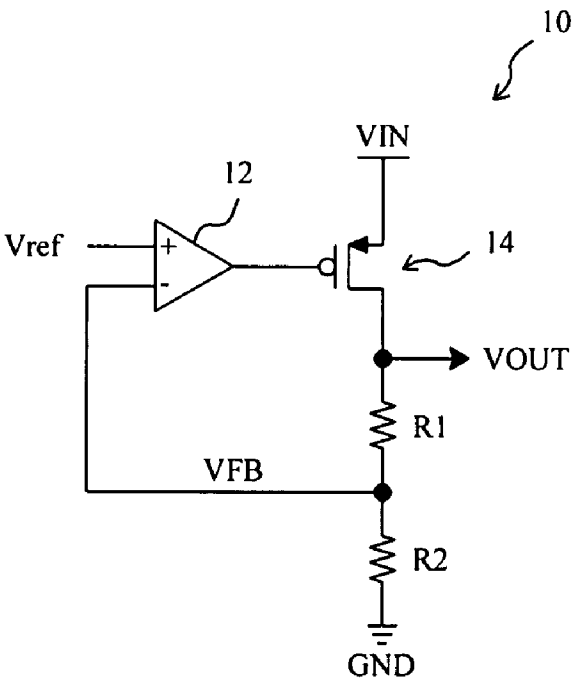
FIG. 2 shows a circuit diagram of a typical LDO regulator.
Figure 1:
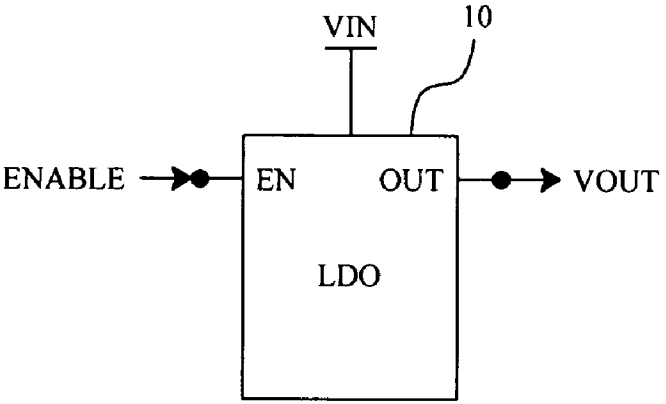
FIG. 1 PRIOR ART
FIG. 1 shows a LDO regulator.
Figure 3:
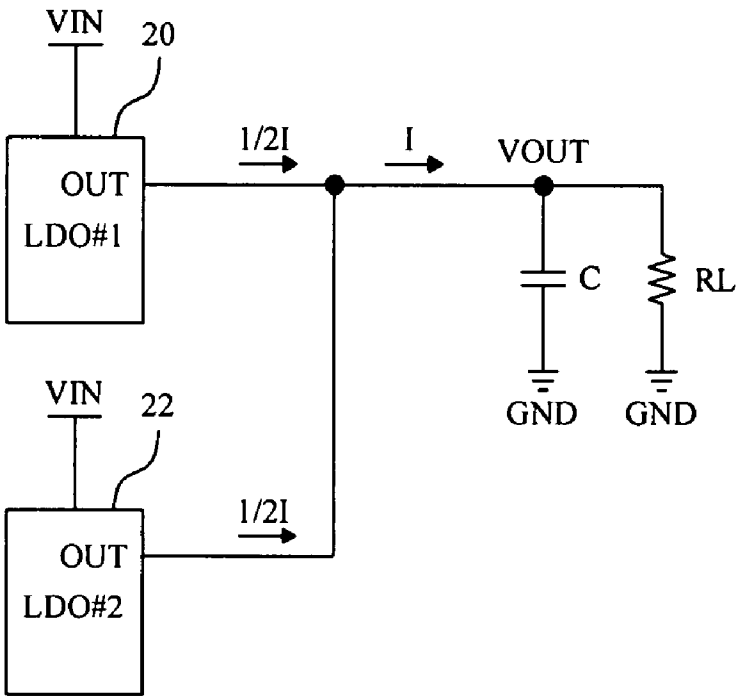
FIG. 3 PRIOR ART
FIG. 3 shows an ideal solution for thermal dissipation issue by using multiple LDO regulators.
Figure 4:
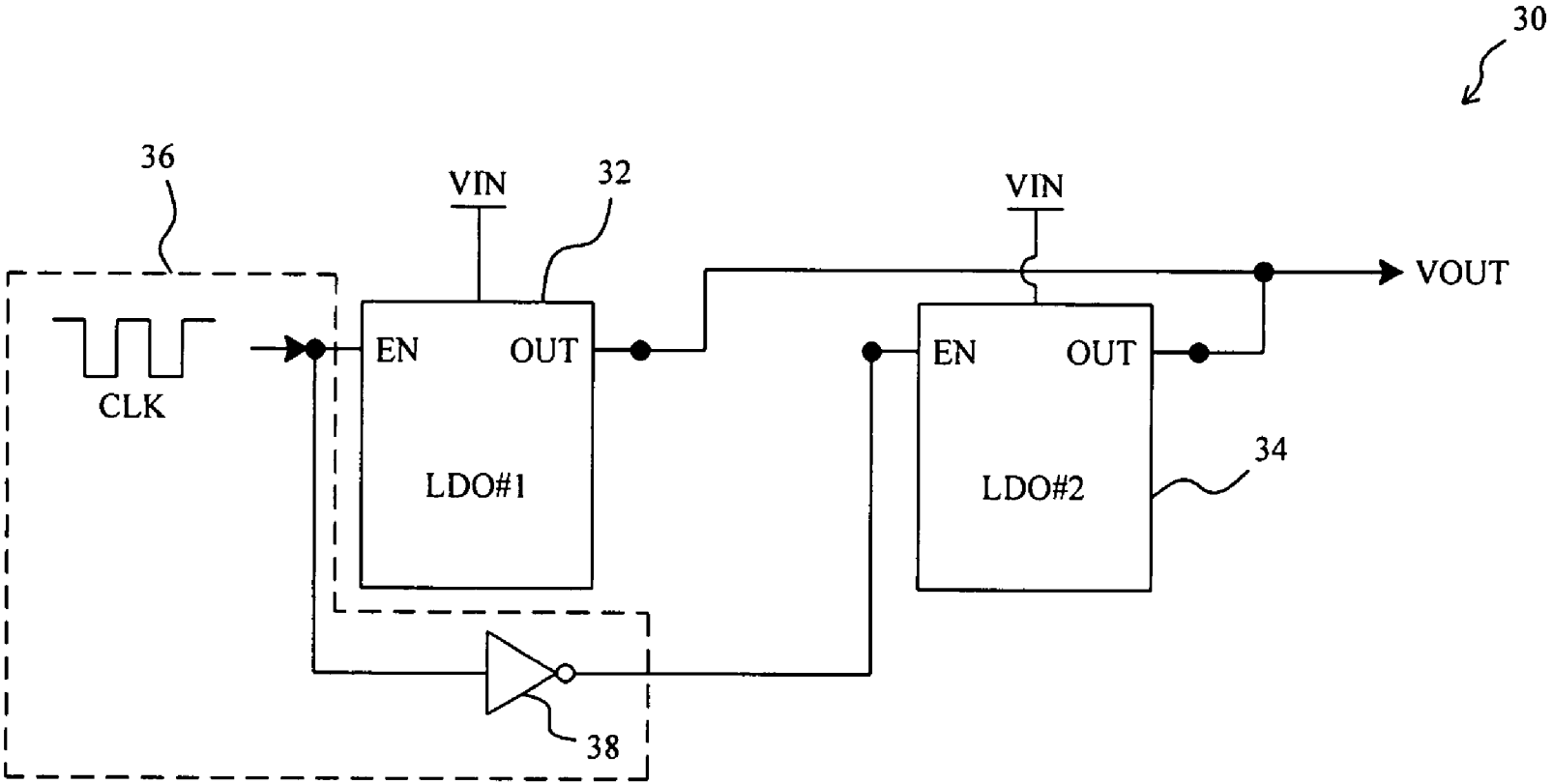
FIG. 4 shows a first embodiment according to the present invention.

As shown in FIG. 4, a power supply arrangement 30 comprises two common-output LDO regulators 32 and 34, each of which can individually convert the input voltage VIN to a supply voltage VOUT. However, a switch circuit 36 is further provided to enable the LDO regulators 32 and 34 with a clock CLK. The clock CLK is connected to the enable input EN of the LDO regulator 32 directly, and to the enable input EN of the LDO regulator 34 through an inverter 38. When the clock CLK is logical high, the LDO regulator 32 is enabled by the clock CLK, and thus it converts the input voltage VIN to the supply voltage VOUT. In this phase, the LDO regulator 34 is disabled because of the inverter 38. When the clock CLK changes to logical low, the low LDO regulator 32 is disenabled, and the LDO regulator 34 is enabled instead, to convert the input voltage VIN to the supply voltage VOUT. As such, each time only one of the LDO regulators 32 and 34 is enabled, and the LDO regulators 32 and 34 are switched by turns, the heat generated in the power supply arrangement 30 is shared by the LDO regulators 32 and 34. Further, at any time only one of the LDO regulators 32 and 34 operates to supply the regulated voltage VOUT, so that there is no need to worry about the voltage generated by one of the LDO regulators 32 and 34 will be higher than that by the other one.

Figure 5:
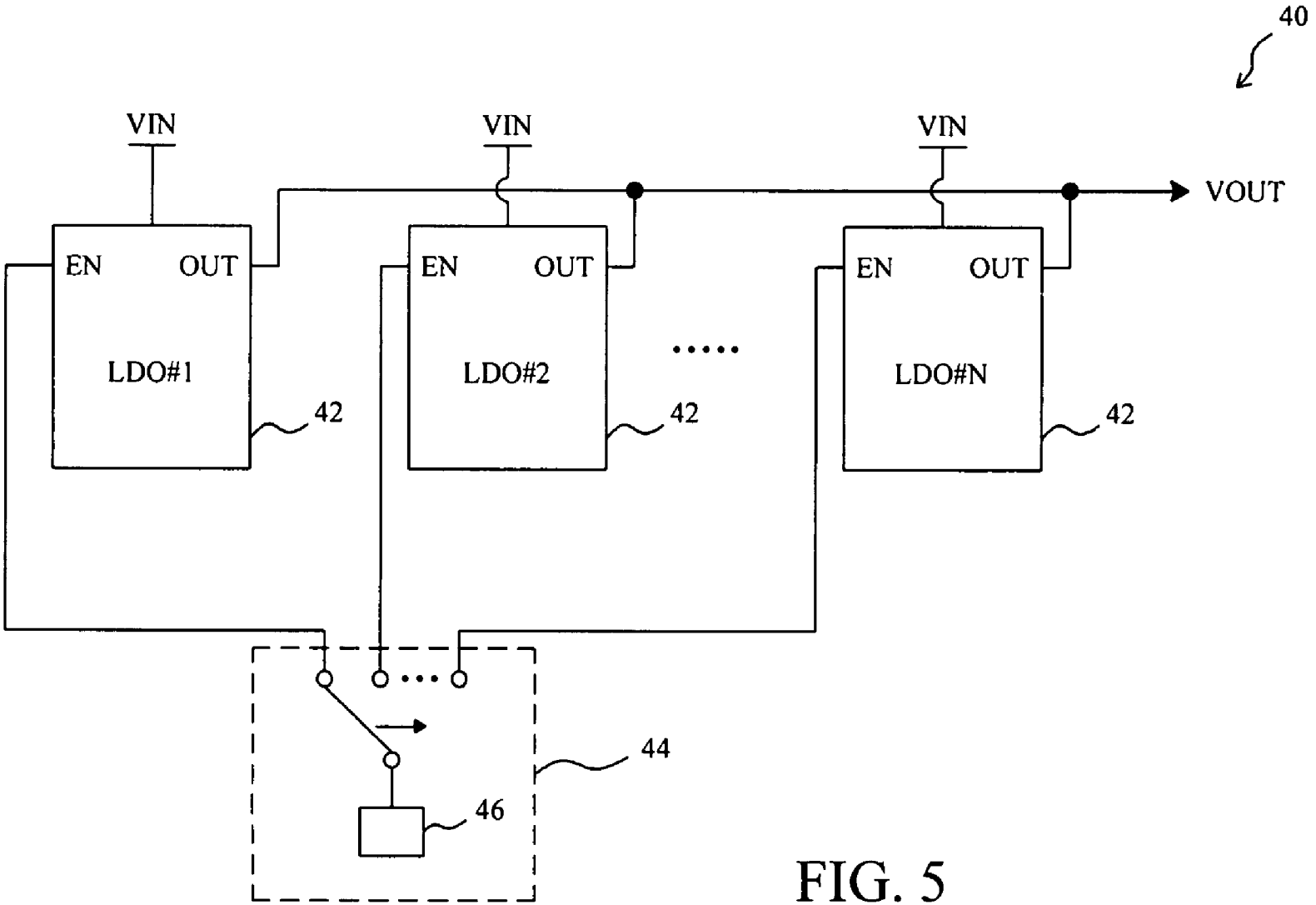
FIG. 5 shows a second embodiment according to the present invention.

FIG. 5 shows a second embodiment according to the present invention. In a power supply arrangement 40, a plurality of common-output LDO regulators 42 are alternatively switched by a switch circuit 44. All the enable pins EN of the LDO regulators 42 are parallel connected to the switch circuit 44, and the switch circuit 44 uses a time-sharing multiplexer 46 to switch between the LDO regulators 42 by turns. Each time only one of the LDO regulators 42 will be enabled to convert the input voltage VIN to the supply voltage VOUT, and therefore the heat generated in the power supply arrangement 40 is shared by the LDO regulators 42, without causing any output deviation issue.

Figure 6:
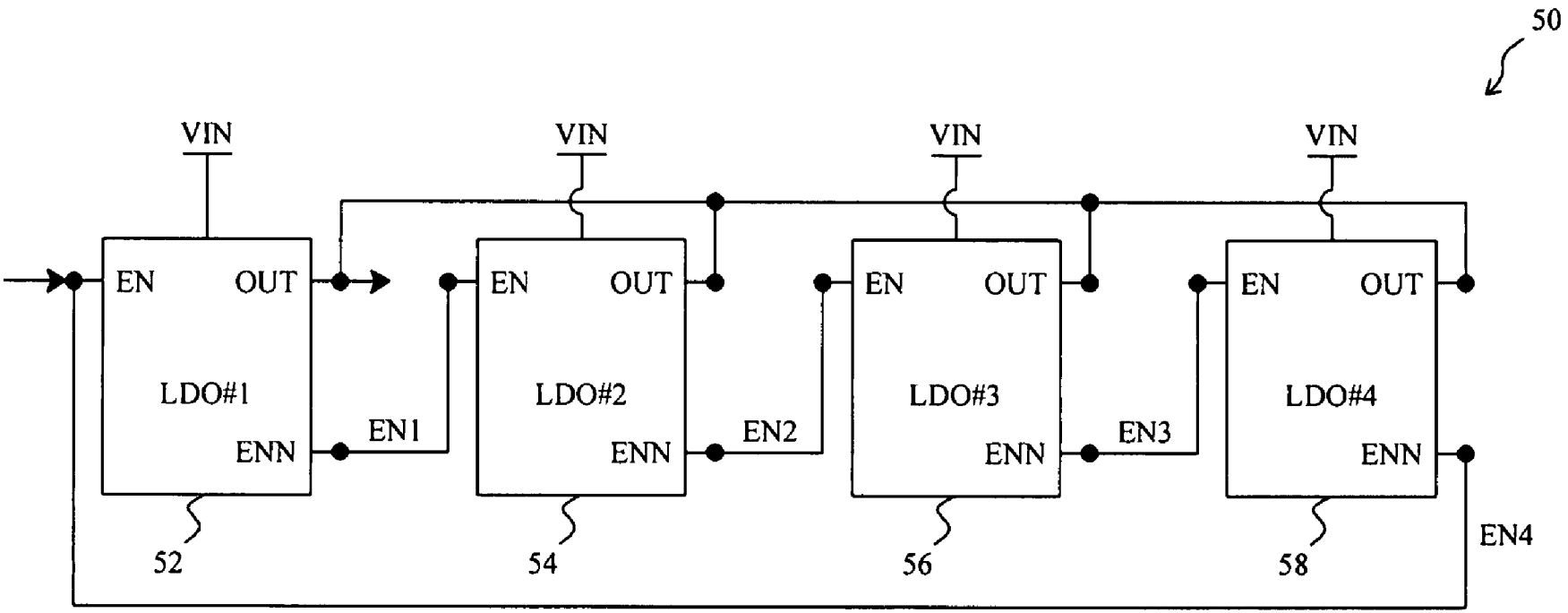
FIG. 6 shows a third embodiment according to the present invention.

In a power supply arrangement 50 shown in FIG. 6, common-output LDO regulators 52, 54, 56 and 58 are connected in a ring, in such a manner that each of the LDO regulator 52, 54, 56 and 58 provides the enable signal for the next stage. When the first LDO regulator 52 is enabled, it converts the input voltage VIN to the supply voltage VOUT, and the other LDO regulators 54, 56 and 58 are disabled. After operating for a time period, the first LDO regulator 52 disables itself and provides an enable signal EN1 to enable the second LDO regulator 54. Similarly, after operating for a time period, the second LDO regulator 54 disables itself and provides an enable signal EN2 to enable the third LDO regulator 56, and then after operating for a time period, the third LDO regulator 56 disables itself and provides an enable signal EN3 to enable the fourth LDO regulator 58, and then after operating for a time period, the fourth LDO regulator 58 disables itself and provides an enable signal EN4 to enable the first LDO regulator 52. As such, each time only one of the LDO regulators 52, 54, 56 and 58 is enabled to convert the input voltage VIN to the supply voltage VOUT. In other embodiments, the switching between the LDO regulators 52, 54, 56 and 58 may be triggered by other parameters, such as temperature. For example, any of the LDO regulators 52, 54, 56 or 58 operates until it detects its temperature reaches a certain value, even though its operating time not so long to reach the threshold, it will disable itself and provide the enable signal to enable the next LDO regulator.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A power supply arrangement for providing a supply voltage to a load, the power supply arrangement comprising:

a plurality of common-output linear regulators, each being configured for converting an input voltage to the supply voltage on a common output;

wherein the plurality of linear regulators are configured in a cascaded ring arrangement, each linear regulator being enabled to operate for a predetermined time period and upon disablement thereafter outputting an enable signal to enable the next cascaded linear regulator.

2. A power supply arrangement for providing a supply voltage to a load, the power supply arrangement comprising:

a plurality of common-output linear regulators, each being configured for converting an input voltage to the supply voltage on a common output;

wherein the plurality of linear regulators are configured in a cascaded ring arrangement, each linear regulator being disabled from operation responsive to a temperature thereof reaching a predetermined threshold, the linear regulator thereafter providing an enable signal to enable the next linear regulator.

3. A control method for a power supply arrangement to provide a supply voltage to a load, the power supply arrangement including a plurality of common-output linear regulators, the control method comprising:

configuring the plurality of linear regulators in a cascaded ring arrangement; and switching the plurality of linear regulators in turn, to alternatively operate one exclusive of the other, for converting an input voltage to the supply voltage on a common output, the switching being responsive to an enable signal output from each linear regulator to enable the next cascaded linear regulator.

4. The control method of claim 3, wherein each linear regulator is enabled to operate for a predetermined time period and upon disablement thereafter outputs the enable signal to enable the next linear regulator.

5. A control method for a power supply arrangement to provide a supply voltage to a load, the power supply arrangement including a plurality of common-output linear regulators, the control method comprising:

switching the plurality of linear regulators in turn, to alternatively operate one exclusive of the other, for converting an input voltage to the supply voltage on a common output, the plurality of linear regulators being sequentially switched, each linear regulator being disabled from operation responsive to a temperature thereof reaching a predetermined threshold, the linear regulator thereafter providing an enable signal to enable the next linear regulator.

* * * * *

UNITED STATES PATENT AND TRADEMARK OFFICE

CERTIFICATE OF CORRECTION

PATENT NO. : 7,619,396 B2
APPLICATION NO. : 11/526624
DATED : November 17, 2009
INVENTOR(S) : Chuang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 42 days.

Signed and Sealed this

Fourteenth Day of December, 2010

David J. Kappos

David J. Kappos
*Director of the United States Patent and Trademark Office*